US006068048A

United States Patent [19]

Cude

[11] Patent Number: 6,068,048

[45] Date of Patent: May 30, 2000

[54] WIRE HARNESS RETAINER FOR SPINE FIN AIR CONDITIONING COILS

[75] Inventor: James Russell Cude, Tyler, Tex.

[73] Assignee: American Standard Inc., Piscataway, N.J.

[21] Appl. No.: 09/265,301

[22] Filed: Mar. 9, 1999

[51] Int. Cl.[7] ..... F28F 9/007

[52] U.S. Cl. ..... 165/125; 248/71; 248/73; 248/51; 62/298

[58] Field of Search ..... 248/71, 73, 51; 62/298; 174/135, 6, 40 CC, 72 A, 158 R, 158 F, 161 F, 163 F; 165/122, 125

[56] References Cited

U.S. PATENT DOCUMENTS

| | | | |
|---|---|---|---|
| 3,444,596 | 5/1969 | Soltysik | 248/71 |
| 4,036,292 | 7/1977 | Hine, Jr. | 165/122 |
| 4,380,263 | 4/1983 | Wright | 165/125 |
| 4,385,504 | 5/1983 | Perrone et al. | 62/259.1 |
| 4,391,322 | 7/1983 | Ciarlei et al. | 165/125 |
| 4,392,525 | 7/1983 | O'Mara et al. | 165/125 |
| 4,434,841 | 3/1984 | Jackson et al. | 165/125 |
| 4,465,125 | 8/1984 | Haas | 165/76 |
| 4,492,269 | 1/1985 | Jennings et al. | 165/125 |
| 4,681,288 | 7/1987 | Nakamura | 248/71 |
| 4,709,556 | 12/1987 | Hupfer | 62/298 |
| 4,945,982 | 8/1990 | Das | 165/125 |
| 5,039,040 | 8/1991 | Idjakiren | 248/73 |
| 5,765,787 | 6/1998 | De Beers et al. | 248/73 |

*Primary Examiner*—Ira S. Lazarus
*Assistant Examiner*—Tho Duong
*Attorney, Agent, or Firm*—William J. Beres; William O'Driscoll; Peter D. Ferguson

[57] ABSTRACT

A wire retainer for use in an air conditioning outdoor cabinet which houses a fan and a spine fin heat exchanger coil includes an extension portion, a base portion and a clip portion. The extension portion of the wire retainer is anchor-like and includes fluke-like members that, when inserted into and through spine fin material, lodge securely therein. The base portion of the retainer abuts the spine fin of the heat exchanger coil and positions the clip portion such that wires or a wire bundle running interior of the coil can be guided and secured appropriately so as not to be cut by the fan or buffeted and broken by the relatively high velocity, high volume stream of air that is drawn by the fan through the interior of the air conditioning cabinet and the heat exchanger coil housed therein.

26 Claims, 4 Drawing Sheets

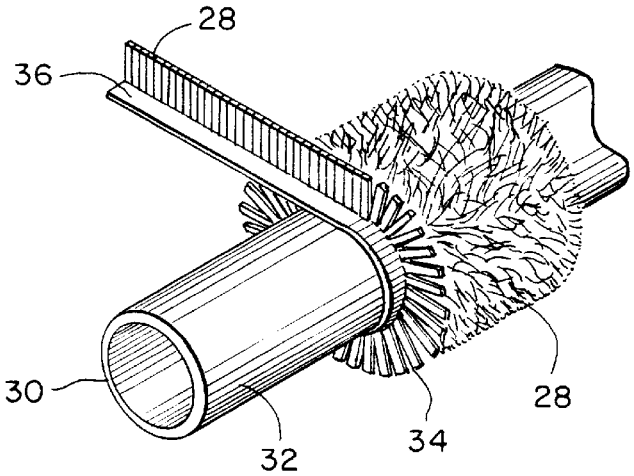
FIG. 3
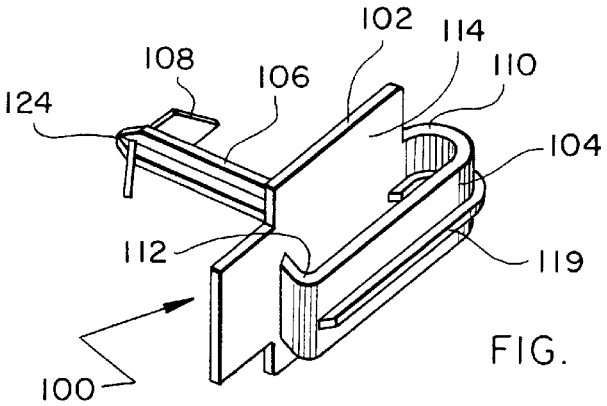
FIG. 4
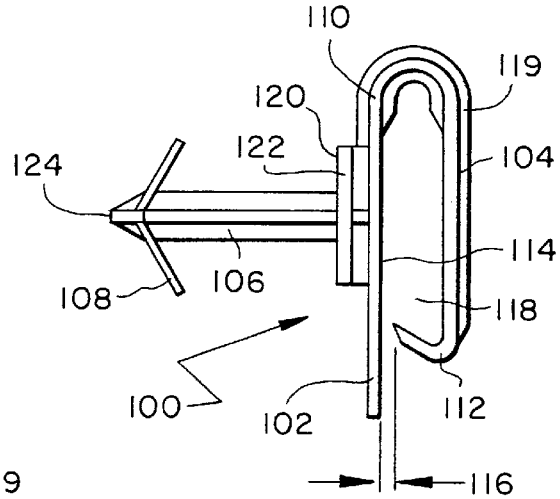
FIG. 5
FIG. 6
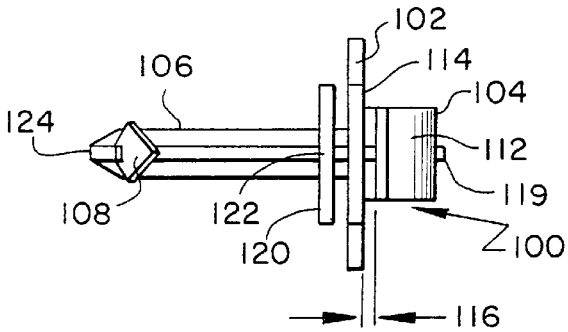

WIRE HARNESS RETAINER FOR SPINE FIN AIR CONDITIONING COILS

BACKGROUND OF THE INVENTION

The present invention relates to wire harness retainers for use in air conditioning outdoor cabinets. More specifically, the present invention relates to wire harness retainers for use in conjunction with air conditioning heat exchanger coils of the spine fin type.

Air conditioning outdoor units, particularly those used in residential applications, are enclosures in which a heat exchanger coil, a compressor, a fan and certain control components are generally housed. The compressor typically sits at the bottom of the outdoor unit with the fan at the top. Both are electrically driven and controlled. As such, wires need to be run within the cabinet of an air conditioning outdoor unit, internal of the heat exchanger coil, to and from the compressor, to and from the fan and from and to and from a controls compartment. Because the fan draws air through the outdoor cabinet and through the heat exchanger coil housed therein at a relatively very high velocity and rate, any wires internal of the unit must be anchored/guided so as not to be cut by the fan blade or broken or fatigued by buffeting in the air stream that flows through the cabinet.

In certain air conditioning outdoor units, heat exchanger coils of the spine fin type are employed, such material having relatively densely packed bristly, spine-like projections. By its nature, spine fin material is not amenable to having other components or items attached or secured to it such as by the use of tie wraps or similar such straps. As such, the need to secure/guide wires or a wire bundle internal of a spine fin heat exchanger coil is problematic. The need therefore exists for a device by which to retain and guide wires and/or a wire bundle internal of an outdoor air conditioning unit having a heat exchanger coil of the spine fin type. Such device will, of necessity, be relatively inexpensive of manufacture, easily installed and readily securable to spine fin material.

SUMMARY OF THE INVENTION

It is an object of the present invention to provide a retainer for wires or a wire harness internal of an outdoor air conditioning cabinet.

It is a further object of the present invention to provide a wire harness retainer that is easily securable to a spine fin heat exchanger coil.

It is a still further object of the present invention, by providing for the assured securing of wires within an air conditioning outdoor cabinet against buffeting and/or breakage as a result of the airflow therethrough, to allow for the use of wire having thinner insulation in an air conditioning outdoor cabinet so as to achieve cost savings thereby.

It is a further object of the present invention to provide a retainer/guide for wires or a wire harness in an outdoor air conditioning cabinet that is adapted for use with and is readily securable to a spine fin heat exchanger coil, is easily and quickly put in place and is inexpensive of manufacture.

These and other objects of the present invention, which will be apparent from the following Description of the Preferred Embodiment and attached drawing figures, are accomplished by a wire harness retainer fabricated from an engineered material, such as nylon, that is preferably ultraviolet light resistant and includes an extension portion which protrudes from one side of a plate-like base portion and has anchor-like flukes on its distal end. A clip having an opening or gap through which wires or a wire bundle can be inserted is formed on the other side of the base portion. The extension portion, with its fluke-like members, is easily and quickly insertable into and through the relatively densely packed spine fins of a spine fin heat exchanger coil. The flukes lodge themselves within the spine fins in a manner which secures the retainer to the coil and prevents the retainer from being withdrawn thereoutof other than with the purposeful use of significant force. As a result, the wire retainer, which is inexpensive of manufacture, is quickly and securely put in place and a securely mounted clip/guide is made available internal of the coil through which wires or a wire bundle can be run.

DESCRIPTION OF THE DRAWINGS

FIG. 3 illustrates the nature of spine fin heat transfer surface and demonstrates the process by which it is wound onto its base tubing.

FIG. 4 is a perspective view of the wire retainer/guide of the present invention.

FIGS. 5 and 6 are side and bottom views of the wire retainer/guide of the present invention.

DESCRIPTION OF THE PREFERRED EMBODIMENT

Figure 1:
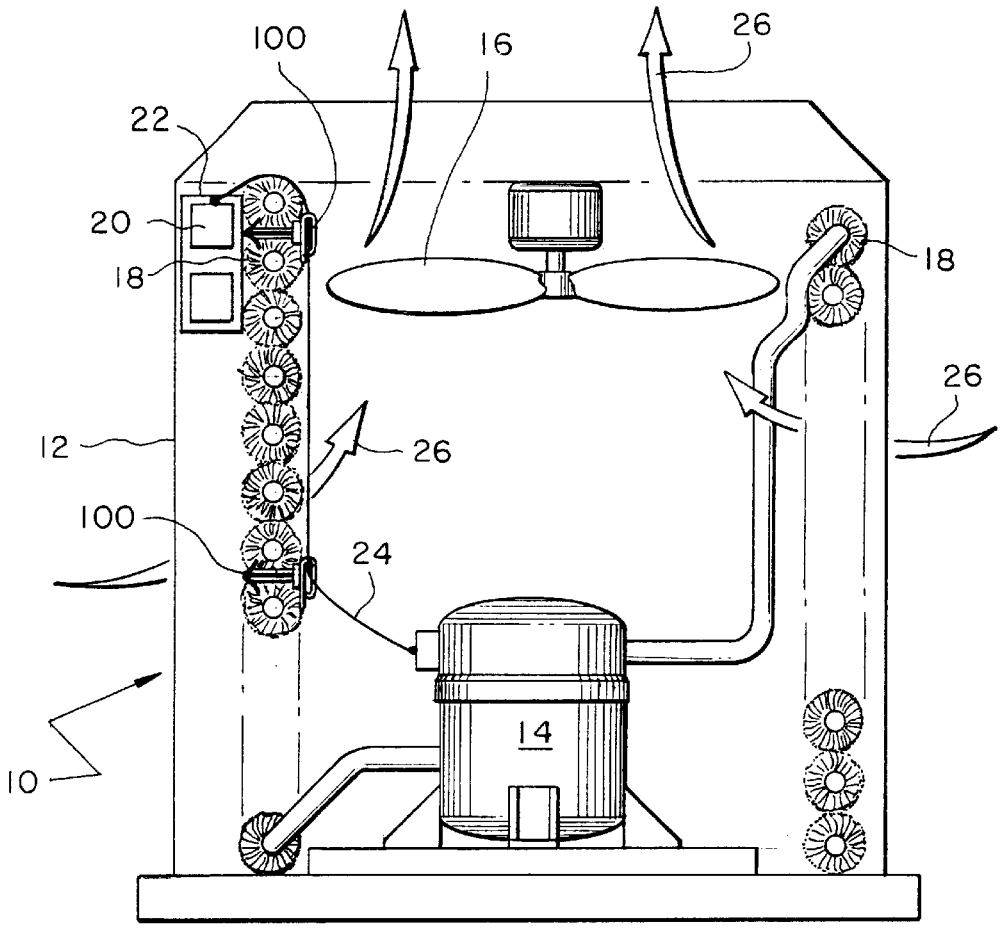
FIG. 1 is a schematic cross-sectional view of an air conditioning outdoor cabinet in which a spine fin heat exchanger coil is employed.

Referring first to Drawing FIG. 1, an air conditioning outdoor unit 10 consists of a cabinet 12 in which a compressor 14, a fan 16 and a heat exchanger coil 18 are housed. Compressor 14 is electrically connected to unit controls 20, which are housed in a compartment 22 defined within cabinet 12, by wire bundle 24.

In operation, fan 16 draws air, indicated by arrows 26, into and through cabinet 12 and heat exchanger coil 18. Air passing through coil 18 cools the refrigerant that flows internal thereof and is discharged, in the preferred embodiment, upwardly by fan 16 back to the atmosphere.

The rate and volume of airflow through the interior of cabinet 12 is high and it will be appreciated that wire bundle 24 will be severely and continuously buffeted about if not secured thereagainst, such as by retainers 100 as will further be described. The buffeting of such wires can, of course, lead to wire fatigue and breakage which, if it occurs, can disable the air conditioning unit. Also of concern is the possibility that the fan might cut one or more such wires if they are not adequately secured against being drawn thereinto. The term "wire bundle", as used herein, is to be construed to refer to an individual wire, multiple loose individual wires or a harness consisting of several individual wires that are wrapped or bound together in a harness the diameter of which can be on the order of from 5/16 to ½ inch.

Figure 2:
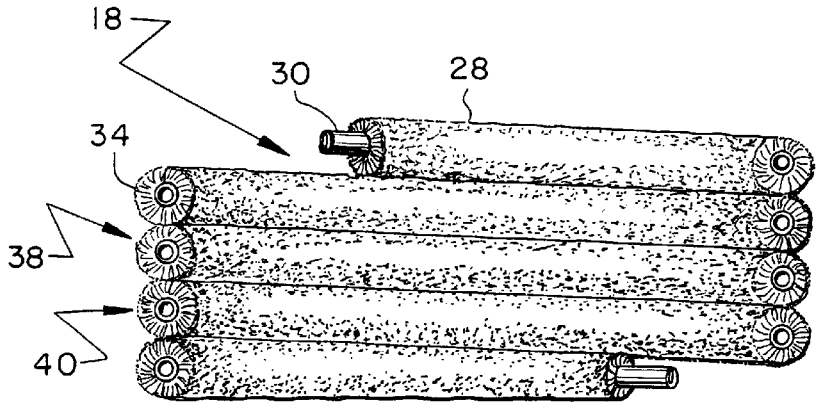
FIG. 2 illustrates a portion of a spine fin heat exchanger coil showing adjacent tube rows thereof.
Figure 7:
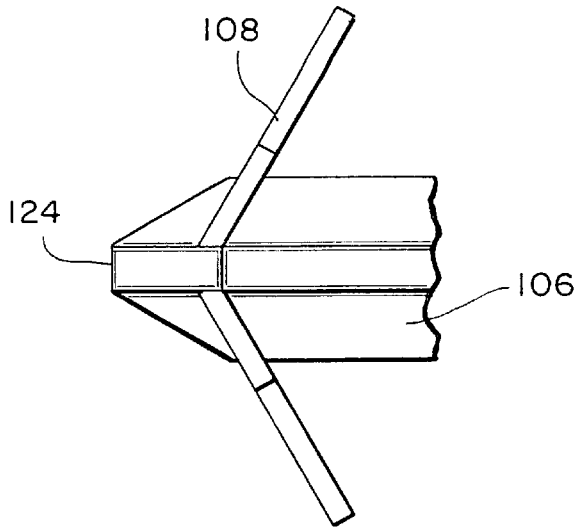
FIG. 7 is an enlarged view of the terminal end of the extension portion of the wire retainer/guide of the present invention.

Referring additionally now to FIGS. 2 and 3, heat exchanger coil 18 is of the spine fin type in which so-called spine fin material 28 is wrapped around tubing 30 that is formed, in the preferred embodiment, into a vertically stacked coil. As is illustrated in FIG. 3, the spine fin heat transfer material, which is wound around the exterior surface 32 of tubing 30, consists of a myriad of individual spines 34 that extend from a common base portion 36. Coil 18 is fabricated such that the spines 34 of a first turn or tube row 38 in heat exchange coil 18 become, at least to some extent, packed and intermingled with the spines of adjacent coil tube rows or turns, such as turn 40, in the process of coil fabrication.

Because the spines 34 of adjacent wraps of the heat exchanger coil are intermingled and to some extent packed, they are not amenable to having typical fastening devices, such as tie wraps, nylon straps or the like placed around them for purposes of having other components secured thereto. Among the reasons that typical tie-wraps/straps are not amenable for use in the context of securing an item or component to a spine fin heat exchanger coil is that most such wraps/straps require that a first end thereof be brought around the structure (in this case, the spine fin wrapped tubing) to which the item or component is to be secured and then be brought back around both the structure and the item or component which is to be secured. The densely packed spines between adjacent tubes prevent or at least make extremely difficult and time consuming the manipulation of such wraps or straps for such purposes by individuals assembling air conditioning outdoor cabinets.

Referring additionally now to FIGS. 4, 5, 6 and 7, the preferred embodiment of wire harness retainer 100 of the present invention is illustrated and includes a generally, though not necessarily, planar base 102, a clip 104, and an anchor-like extension portion 106 at the distal end of which are fluke-like members 108. Retainer 100 will preferably be formed as a unitary piece from a relatively inexpensive yet durable engineered material, such as nylon or another kind of plastic, which is strong yet has some flexibility/resiliency and is resistant to being weakened by exposure to ultra-violet light.

Clip 104, in the preferred embodiment, is formed so that a first of its ends 110 extends from base 102, preferably at an edge thereof, while the second end 112 thereof curves back toward and is positioned in contact with or closely proximate to face 114 of base 102. Because retainer 100 is formed of a flexible material, a wire bundle can be slid between second end 112 of clip 104 and face 114 of base 102 and/or through gap 116 between face 114 and end 112 of clip 104, should a gap be defined therebetween, and into retainer space 118, which is defined and circumscribed by face 114 of base portion 102 and clip 104, even though the wire bundle is of a width greater than gap 116.

After a wire bundle is ensconced within retainer space 118, clip end 112 returns, due to its resiliency, into contact with or to the close proximity of face 114 of base 102. As such, once ensconced in space 118, a wire, wires or a wire harness becomes trapped therein and cannot be removed without clip 104 being physically acted upon to pull end 112 of clip 104 away from base 102 to create an opening that is of sufficient size to allow for the removal of the wire bundle. Clip end 112 will preferably curve into space 118 giving wire bundle 24 a cradle on which to rest which it is not prone to having the wire bundle slip out of. In its preferred embodiment of the present invention clip 104 will include a rib 119 that stiffens and strengthens clip 104 so that it will ensure that any wires disposed in space 118 are pressured to remain there even if their number or size tends to push clip 104 away from base 102.

Extension portion 106 of retainer 100 extends from face 120 of standoff portion 122 of base 102. Face 120 and standoff portion 122 are on the side of base 102 which is opposite face 114 thereof. Terminal end 124 of extension portion 106 has at least one and, in the preferred embodiment, two fluke-like members 108 that angle back toward base 102 and, like clip 104, are strong yet at least somewhat flexible.

Figure 8:
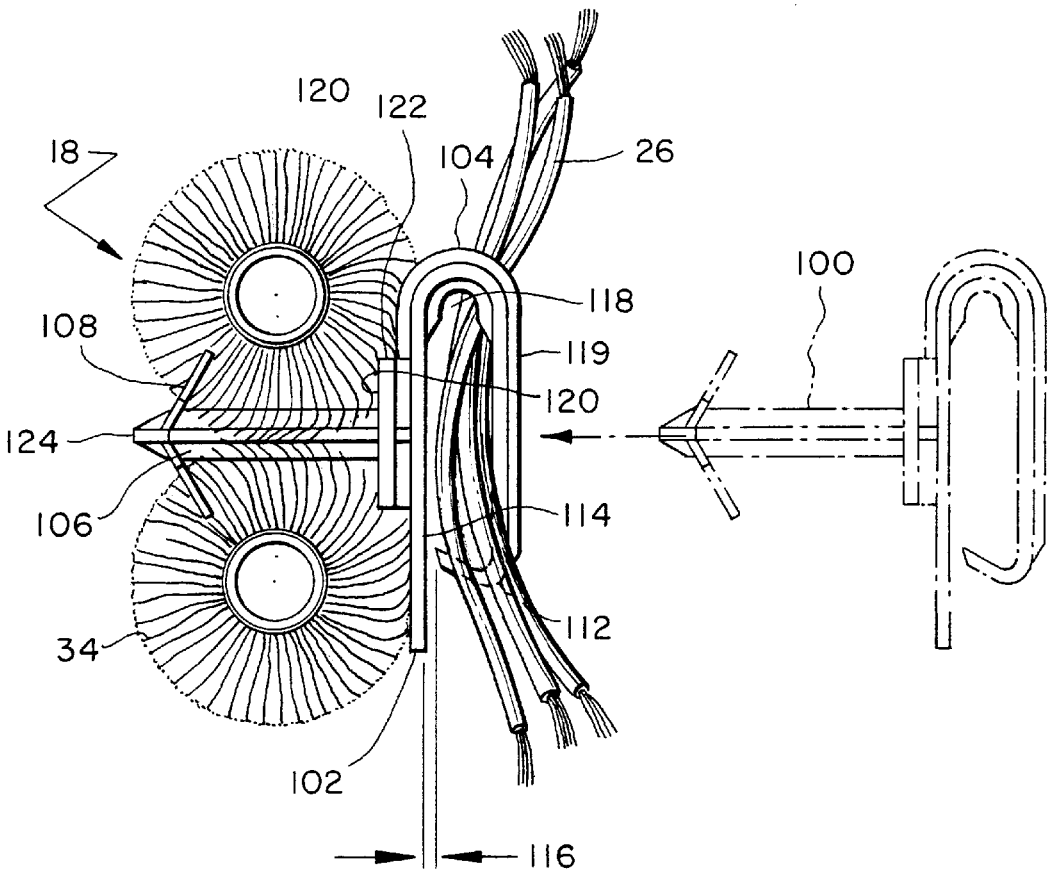
FIG. 8 illustrates the process by which the wire retainer/guide of the present invention is inserted and secured to the spine fin heat exchanger coil.
Figure 9:
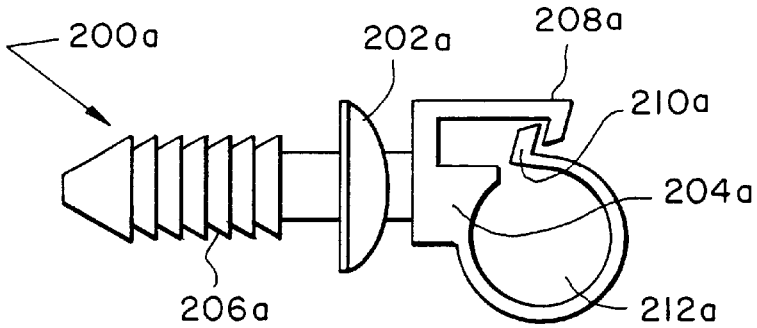
FIGS. 9, 10, 11 and 12 illustrate alternate embodiments of the wire retainer/guide of the present invention.
Figure 10:
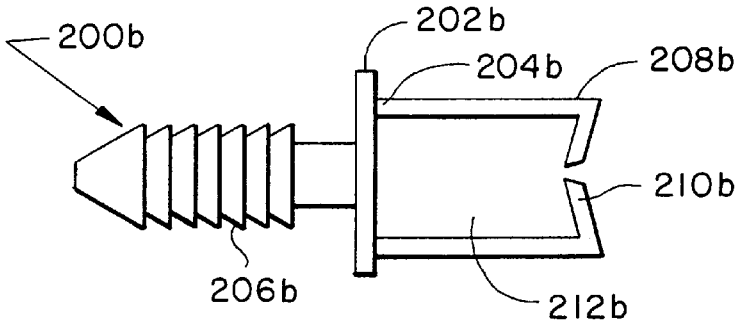
Figure 11:
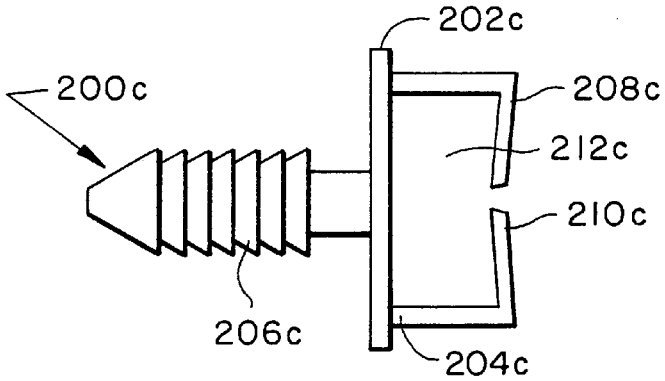
Figure 12:
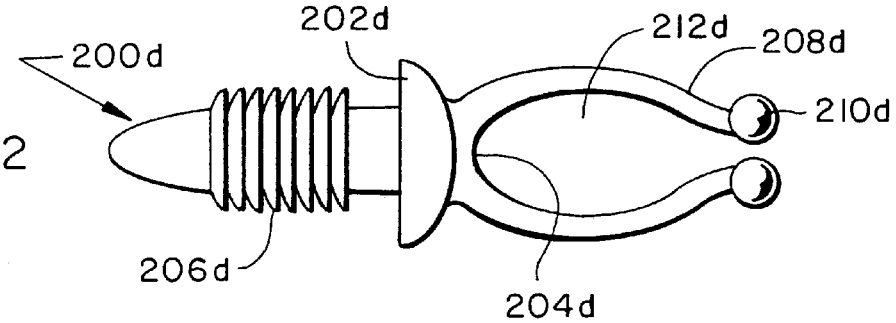

Referring additionally now to FIG. 8, retainer 100 is secured to coil 18 by the simple act of pushing terminal end 124 of the extension portion 106 and its fluke-like members 108 into coil 18 between adjacent turns thereof and into the spine fins 34 therebetween. Face 120 of stand-off portion 122 is sized so that in pushing extension portion 106 of the retainer into the spine fin material, the push process is stopped as face 120 comes into abutment with the spine fin. It should be understood that stand-off portion 122 of wire retainer 100 could be dispensed with and, in such case, that extension portion 106 would extend directly from base 102.

Extension portion 106 of the retainer is of a length which is predetermined to ensure that terminal end 124 of retainer 100 passes sufficiently far into the spine fin material of adjacent tube rows within coil 18 to provide for the secure positioning and retention of the retainer once pushed into place. Because the spines of adjacent tubes are packed, intermingled, resilient and bristly, in pushing terminal end 124 of retainer 100 therethrough, a significant number of individual spine fins 34, will be displaced and pushed out of the way by fluke-like members 108 but will spring back to their original or near-original position after fluke-like members 108 pass by. Many of such spines will become trapped behind the fluke-like members which, once again, angle back toward base 102, effectively securing clip 100 to heat exchanger coil 18 and rendering it nearly impossible to withdraw retainer 100 from the coil other than purposefully and by exerting very significant force. The amount of force necessary to pull retainer 100 from the coil once inserted is such that it will not be experienced as a result of the normal operation of the air conditioning outdoor unit 10 and/or the normal operational flow of air therethrough.

As will be appreciated, retainer 100 is inexpensive of manufacture, particularly in the massive quantities in which used. As will further be appreciated, the ensconcement of wire bundle 24 which, once again, can be a single wire, several individual unconnected wires or a tied or wrapped bundle of wires, within retainer space 118 involves an extremely quick and simple act, that being the act of pushing or pulling wire bundle 24 between clip end 112 and base portion face 114 into the retainer space. Installation of individual retainers 100, two or more of which are likely to be used in each outdoor unit, and the securing thereof to coil 18 is just as quick and simple, requiring only the pushing of terminal end 124 of the retainer into the intertwined spines 34 of adjacent tube rows at appropriate locations in coil 18. Such appropriate locations, advantageously, are generalized and need not be the same from one coil to the next. Further, because retainer 100 does guide the wires internal of air conditioning unit 10 in an efficient and secure fashion, the thickness of the insulation used on the wires, which might otherwise be counted on to provide strength and resistance to breakage of the wire or wire strands running through it, can be reduced which still further reduces the manufactured cost of the air conditioning unit. In sum, a wire bundle running internal of heat exchanger coil 18 within cabinet 12 of outdoor air conditioning unit 10 is quickly, easily, inexpensively and securely retained and guided therewithin by the use of wire retainer 100 of the present invention which, as a further cost benefit, allows for the use of wires having thinner insulation therein.

Referring now to Drawing FIGS. 9, 10, 11 and 12 other embodiments of the present invention are illustrated. These embodiments, like the preferred embodiment, consist respectively of extension portions 200*a*, 200*b*, 200*c* and 200*d*, base portions 202*a*, 202*b*, 202*c* and 202*d* and a clip portions 204*a*, 204*b*, 204*c* and 204*d* with the extension portions having fluke-like members 206*a*, 206*b*, 206*c* and 206*d* of slightly different geometry and configuration but which are still readily insertable through densely packed spine fin coil and which resist being pulled thereoutof once in place. As will be appreciated in each of the embodiments of FIGS. 9, 10, 11 and 12, clip portions 204*a*, 204*b*, 204*c* and 204*d* have first and second resilient arms 208*a*, 208*b*, 208*c* and 208*d* the ends 210*a*, 210*b*, 210*c* and 210*d* of which are in close proximity to each other and are configured to inhibit the removal of a wire bundle, once ensconced in retainer spaces 212*a*, 212*b*, 212*c* and 212*d*, other than by the purposeful forcing apart of those ends.

While the present invention has been described in terms of a preferred and several alternative embodiments, it will be appreciated that the invention is not limited thereto and that other embodiments and modifications thereto fall within its scope.

What is claimed is:

1. An air conditioning outdoor unit comprising:

a cabinet;

a spine fin heat exchanger coil disposed in said cabinet;

a wire harness retainer, said wire harness retainer having a base and an extension portion, said retainer defining a retainer space and said extension portion having at least one fluke-like element extending therefrom, said at least one fluke-like element engaging a plurality of the spines of said spine fin heat exchanger coil to secure said retainer to said coil; and a wire bundle, said wire bundle running internal of said heat exchanger coil and passing through said retainer space.

2. The air conditioning outdoor cabinet according to claim 1 wherein said base abuts said spine fin heat exchanger coil.

3. The air conditioning outdoor cabinet according to claim 2 wherein said retainer space and said extension portion are on opposite sides of said base.

4. The air conditioning outdoor unit according to claim 3 wherein said retainer has a clip portion, said retainer space being defined by said base and said clip portion.

5. The air conditioning outdoor cabinet according to claim 4 wherein said extension portion extends from the face of said base which abuts said spine fin heat exchanger coil.

6. The air conditioning outdoor unit according to claim 5 wherein said clip portion has a first end and a second end, said first end being attached to said base.

7. The air conditioning outdoor unit according to claim 6 wherein said second end of said clip portion is proximate but unattached to said base.

8. The air conditioning outdoor unit according to claim 7 wherein said second end of said clip portion is resiliently displaceable so as to permit the entry of said wire bundle into said retainer space.

9. The air conditioning outdoor unit according to claim 8 wherein said retainer is fabricated from an ultra-violet light resistant engineered material.

10. The air conditioning outdoor unit according to claim 9 wherein said engineered material is nylon.

11. The air conditioning outdoor unit according to claim 4 wherein said base includes a standoff portion, said extension portion of said retainer extending from said stand-portion of said base.

12. The air conditioning outdoor unit according to claim 4 wherein said retainer has at least two fluke-like elements.

13. The air conditioning outdoor cabinet according to claim 4 wherein said clip portion has first and second resilient arms, said first and second resilient arms cooperating in the definition of said retainer space and the terminal ends of which are in close proximity and are configured to hinder the movement of said wire bundle out of said retainer space, once passing therethrough, other than by the forceful parting of said terminal ends.

14. A wire harness retainer for use with a spine fin heat exchanger coil comprising:

a unitary piece having a base and an extension portion, said retainer defining a retainer space, said retainer space being on a first side of said base and said extension portion extending from a second side of said base, said extension portion having at least one fluke-like element extending therefrom, said fluke-like element being angled so as to permit the passage thereof through the spines of said spine fin heat exchanger coil in a first direction but to resist the withdrawal thereof back through said spines in a direction away from said first direction.

15. The wire harness retainer according to claim 14 wherein said base is generally planar in nature and wherein said first and said second sides of said base are generally opposite sides thereof.

16. The wire harness retainer according to claim 15 wherein said retainer has a clip portion, said retainer space being defined by said base and said clip portion.

17. The wire harness retainer according to claim 16 wherein said clip portion has a first end and a second end, said first end being attached to said base.

18. The wire harness retainer according to claim 17 wherein said second end of said clip portion is proximate but unattached to said base so as to from a gap therebetween.

19. The wire harness retainer according to claim 17 wherein said base includes a stand-off portion, said extension portion of said retainer extending from said stand portion of said base.

20. The wire harness retainer according to claim 17 wherein said extension portion has at least two fluke-like elements extending from the terminal end thereof.

21. The wire harness retainer according to claim 18 wherein said second end of said clip portion is resiliently displaceable so as to permit the entry of a wire harness into said retainer space where said wire harness is of a thickness which is greater than the gap that exists between said second end of said clip portion and said base.

22. The wire harness retainer according to claim 18 wherein said retainer is fabricated from an engineered material.

23. The wire harness retainer according to claim 22 wherein said engineered material is resistant to damage by ultra-violet light.

24. The wire harness retainer according to claim 15 wherein said retainer has a clip portion attached to said base.

25. The wire harness retainer according to claim 24 wherein said clip portion has first and second legs, said first and second legs defining said retainer space.

26. The wire harness retainer according to claim 25 wherein the ends of said first and said second legs are configured to inhibit the passage of a wire bundle out of said retainer space once said wire bundle is inserted thereinto.

* * * * *